United States Patent [19]

Nagl

[11] Patent Number: 4,507,079

[45] Date of Patent: Mar. 26, 1985

[54] APPARATUS FOR DISCHARGING SOLIDS FROM A SHAFT FURNACE

[75] Inventor: Martin Nagl, Rutzenmoos, Austria

[73] Assignee: Voest-Alpine Aktiengesellschaft, Linz, Austria

[21] Appl. No.: 493,204

[22] Filed: May 10, 1983

[30] Foreign Application Priority Data

May 18, 1982 [AT] Austria ..... 1958/82

[51] Int. Cl.[3] ..... F27B 21/00

[52] U.S. Cl. ..... 432/95; 266/195; 110/275; 110/165 R; 432/242

[58] Field of Search ..... 432/95, 97, 98, 242; 266/195; 34/242; 110/275, 293, 165 R

[56] References Cited

U.S. PATENT DOCUMENTS

| | | | |
|---|---|---|---|
| 2,072,450 | 3/1937 | Hobson, Jr. | 110/275 |
| 3,722,869 | 3/1973 | Moore | 266/195 |
| 3,850,616 | 11/1974 | Cruse, Jr. | 266/195 |
| 4,073,629 | 2/1978 | Funk | 110/165 R |

FOREIGN PATENT DOCUMENTS

| | | |
|---|---|---|
| 337622 | 6/1921 | Fed. Rep. of Germany . |
| 338413 | 6/1921 | Fed. Rep. of Germany . |
| 345027 | 12/1921 | Fed. Rep. of Germany . |

*Primary Examiner*—Henry C. Yuen
*Attorney, Agent, or Firm*—Kurt Kelman

[57] ABSTRACT

Apparatus for discharging solids from a shaft furnace comprises a lock chamber structure, the interior of which is connected to the shaft furnace by a conveyor duct, and a rotor, which is rotatably mounted in the interior of the lock chamber structure and adapted to be driven and arranged to receive solids from the furnace and seals the inlet of the lock chamber from the outlet of the lock chamber. To permit a continuous discharge of solids from the furnace without an escape of gas from the furnace, the rotor consists of a cellular wheel, which has cell-defining walls in a star-shaped configuration. The conveyor duct is connected to a source of a compressed blocking gas. An exhaust gas duct communicates with the interior of the lock chamber structure adjacent to the conveying portion of the cellular wheel between the inlet and the outlet of the cellular wheel.

6 Claims, 3 Drawing Figures

APPARATUS FOR DISCHARGING SOLIDS FROM A SHAFT FURNACE

This invention relates to apparatus for discharging solids from a shaft furnace, comprising a lock chamber structure, the interior of which is connected to the shaft furnace by a conveyor duct, and a rotor, which is mounted in the interior of said lock chamber structure and adapted to be driven and serves to receive solids from the furnace and to seal the inlet of the lock chamber structure from the outlet of the lock chamber structure.

In order to avoid an undesired oxidation and to avoid a raising of dust as far as possible, sponge iron which has been produced by a reduction in a shaft furnace is discharged and briquetted at elevated temperature. A difficulty involved in that operation resides in that an escape of the pressurized furnace gas from the furnace must be prevented. It is known that this can be accomplished in that the solids are discharged from the furnace in batches by means of a container, which is adapted to be attached to the discharge opening of the furnace so that said discharge opening can be closed after the discharge of each batch of solids.

Other known discharge apparatus are disclosed in German Patent Specification Nos. 337,622; 338,413; and 345,027 and comprise a lock chamber structure, the interior of which is connected to the shaft furnace by a discharge duct and in the interior of which a rotor drum is rotatably mounted. The drum is formed in part of its periphery with an opening through which solids from the furnace can be received and can subsequently be discharged from the drum. When the opening in the drum registers with the inlet of the lock chamber structure, solids from the shaft furnace are received by the drum. As the drum is rotated, the shell of the drum closes the inlet of the lock chamber structure and opens the outlet of the lock chamber structure when the opening in the shell of the drum reaches the outlet of the lock chamber structure so that the solids from the furnace can then drop out of the drum through the outlet of the lock chamber structure. That arrangement of a drum has the disadvantage that the solids from the furnace cannot be continuously conveyed through the lock chamber structure and that an undesired escape of furnace gas through the lock chamber structure is not safely prevented. Besides, the rotation of the drum does not result in a conveyance of solids between the inlet and outlet of the lock chamber structure because the solids from the furnace are either rotated in unison with the drum or roll on the inside surface of the drum.

For this reason it is an object of the invention to avoid these disadvantages and so to improve a discharge apparatus of the kind described first hereinbefore that a continuous discharge of solids at a relatively high rate is ensured and an escape of gas from the furnace will be prevented.

This object is accomplished in accordance with the invention in that the rotor consists of a cellular wheel having cell-defining walls in a starlike configuration, the conveyor duct is connected to a source of compressed blocking gas, and the interior of the lock chamber structure communicates between its inlet and outlet with an exhaust gas duct adjacent to the conveying portion of the cellular wheel.

The combination of the lock chamber structure with a cellular wheel constitutes a structurally simple pressure lock, which operates continuously and does not involve a pressure loss in the furnace. The blocking gas is introduced into the conveyor duct between the conveying device and the lock chamber structure and must be under a presure which is at least as high as the pressure of the furnace gas. That blocking gas prevents an escape of the furnace gas as far as to the interior of the lock chamber structure. To ensure that blocking gas will not be carried along through the interior of the lock chamber together with the solids from the furnace, an exhaust gas duct communicates with the interior of the lock chamber between its inlet and outlet adjacent to the conveying portion of the cellular wheel and serves to discharge the blocking gas which has entered the interior of the lock chamber structure.

The required pressure drop in the lock chamber structure is due to the fact that the cell-defining walls contact the inside peripheral surface of the lock chamber structure to provide a seal between the inlet and the outlet of the lock chamber structure. Because that seal cannot be perfectly gas-tight owing to the clearance required between the cellular wheel and the lock chamber structure, the blocking gas will enter the lock chamber structure between the cell-defining walls of the cellular wheel and the inside surface of the lock chamber structure in a direction which is opposite to the direction in which the solids are conveyed by the cellular wheel. In order to prevent an escape of that portion of the blocking gas from the lock chamber structure, another exhaust gas duct may communicate with the interior of the lock chamber between its inlet and outlet adjacent to the empty returning portion of the cellular wheel.

To ensure that the required pressure of the blocking gas can be built up in the conveyor duct between the conveying device and the lock chamber structure with a low expenditure, a direct communication between the conveyor duct and the exhaust gas ducts through a cell chamber of the cellular wheel must be prevented. Moreover, a free communication between the exhaust gas ducts and the outlet of the lock chamber structure must be prevented if an escape of blocking gas from the lock chamber structure is to be precluded. If the angular spacing of two adjacent cell-defining walls of the cellular wheel is smaller than the angular spacing of the inlet and the outlet of the lock chamber structure from each exhaust gas duct, at least one cell-defining wall of the cellular wheel will be disposed between each exhaust gas duct and the inlet and outlet of the lock chamber structure in any rotational position of the cellular wheel so that the flow paths which would otherwise be possible will safely be interrupted, as is required.

It is of special importance that only the hot solids from the furnace and hardly any blocking gas can pass through the lock chamber structure. For this reason the sealing of the lock chamber structure between its outlet and the exhaust gas ducts is of special significance. To ensure that the lock chamber structure is sealed by the cellular wheel as tightly as is required, the angular spacing between each exhaust gas duct and the outlet of the lock chamber structure may be more than twice the angular spacing of two adjacent cell-defining walls so that there will be at least two cell-defining walls between the exhaust gas ducts and the outlet of the lock chamber structure in any rotational position of the cellular wheel.

In accordance with the invention the cellular wheel is used to seal a lock chamber structure as tightly as possible rather than for metering purposes. For this reason the cell-defining walls of the cellular wheel must extend close to the inside surface of the lock chamber structure. It must be borne in mind that the solids from the furnace which pass through the lock chamber structure are at relatively high temperatures of, e.g., 750° C. so that in spite of an effective heat insulation a radiation of heat cannot be avoided. As a result, the walls of the lock chamber structure will be at a lower temperature than the cellular wheel which is mounted in the lock chamber structure. The cellular wheel must be rotatable in spite of the differential expansion which is due to that temperature difference. For this reason, adequate expansion joints are required between the cellular wheel particularly while the apparatus is started up from a cold state to the operating temperature. The largest temperature differences will occur during that starting-up period and should not exceed certain limits so that very large expansion joints will not be required. The axial expansion joint between the cellular wheel and the lock chamber structure will not affect the gastight seal of the lock chamber structure by the cellular wheel if the latter comprises two end discs disposed on opposite sides of the cell-defining walls. These end discs will gas-tightly seal the cells in an axial direction even though the cell-defining walls do not contact the end walls of the lock chamber structure. For this reason the seal of the lock chamber structure will not be adversely affected although the clearance between the end discs of the cellular wheel and the end walls of the lock chamber structure is sufficient to take up the thermal expansion of the cellular wheel relative to the lock chamber structure. But owing to that axial clearance between the end walls of the cellular wheel and the end walls of the lock chamber structure there may be a flow passage for the blocking gas which has passed through between the end walls of the cellular wheel and the peripheral wall of the lock chamber structure and may then reach the outlet of the lock chamber structure rather than the regions of the exhaust gas ducts. In order to obstruct the flow of gas to the outlet of the lock chamber structure, each end disc of the cellular wheel may be provided within the scope of the invention with at least one annular flange, which protrudes toward the adjacent end wall of the lock chamber structure and surrounds and defines a sealing joint with a mating flange that is provided on the adjacent end wall of the lock chamber structure. Because the annular flange and the mating flange are concentrically interfitted, the axial expansion of the cellular wheel will not be restricted by these flanges, which close the space between the end of the cellular wheel and the lock chamber structure. As the annular flange provided on the cellular wheel surrounds the mating flange of the lock chamber structure, the radial expansion of the cellular wheel will not be restricted by said flanges because the cellular wheel will be at a higher temperature and will exhibit a larger expansion than the lock chamber structure. The width of the sealing gaps between each annular flange and the associated mating flange will increase with the temperature difference between the cellular wheel and the lock chamber structure as the apparatus is started up and will decrease to the desired extent when the operating temperature has been reached and the temperature difference between the cellular wheel and the lock chamber structure is decreasing. The increase of the width of the sealing gap between the annular flange and the mating flange during starting-up will not adversely affect the tightness of the lock chamber structure because the increase of the width of that sealing gap is accompanied by a larger radial expansion of the cellular wheel so that the radial gaps between the cell-defining walls and the end discs of the cellular wheel, on the one hand, and the peripheral wall of the lock chamber structure, on the other hand, will decrease so that the sealing action can be expected to remain approximately constant under all operating conditions.

The solids from the furnace are at a high temperature and should pass through the lock chamber structure with minimum heat losses. That high temperature involves a relatively high heat loading of the bearings for the shaft of the cellular wheel. In order to reduce that heat loading, at least one annular cooling passage for conducting a coolant may be provided between the lock chamber structure and the shaft carrying the cellular wheel on that side of each bearing for the shaft which is nearer to the cellular wheel. In that manner, the temperature of the bearing can be decreased and an escape of blocking gas through the shaft bearings can be further restricted. Particularly desirable conditions will be obtained if two axially spaced apart annular cooling passages are provided on each side of the cellular wheel so that the cooling can be effected in a first step with a cold inert gas and in a second step with a liquid coolant, such as water.

A very simple structure will be obtained if the lock chamber structure comprises at each end an annular flange, which axially protrudes toward the adjacent end disc of the cellular wheel, and each end disc of the cellular wheel adjoins one of said annular cooling passages and carries a mating annular flange, which is surrounded by the adjacent annular flange of the lock chamber structure, and a sliding seal ring is disposed between said annular flanges. In that case the required freedom of the cellular wheel to expand relative to the lock chamber structure will not adversely affect the tight seal of the annular cooling passage from the lock structure. In case of such an arrangement of flanges the expansion of the cellular wheel relative to the lock chamber structure will result in a compression of the sliding ring which is clamped between the flanges so that said sliding ring must resiliently yield. The higher pressure applied to the sliding ring will further improve the tight seal of the annular cooling passage.

An illustrative embodiment of the invention is shown in a simplified form in the drawing, in which.

Figure 1:
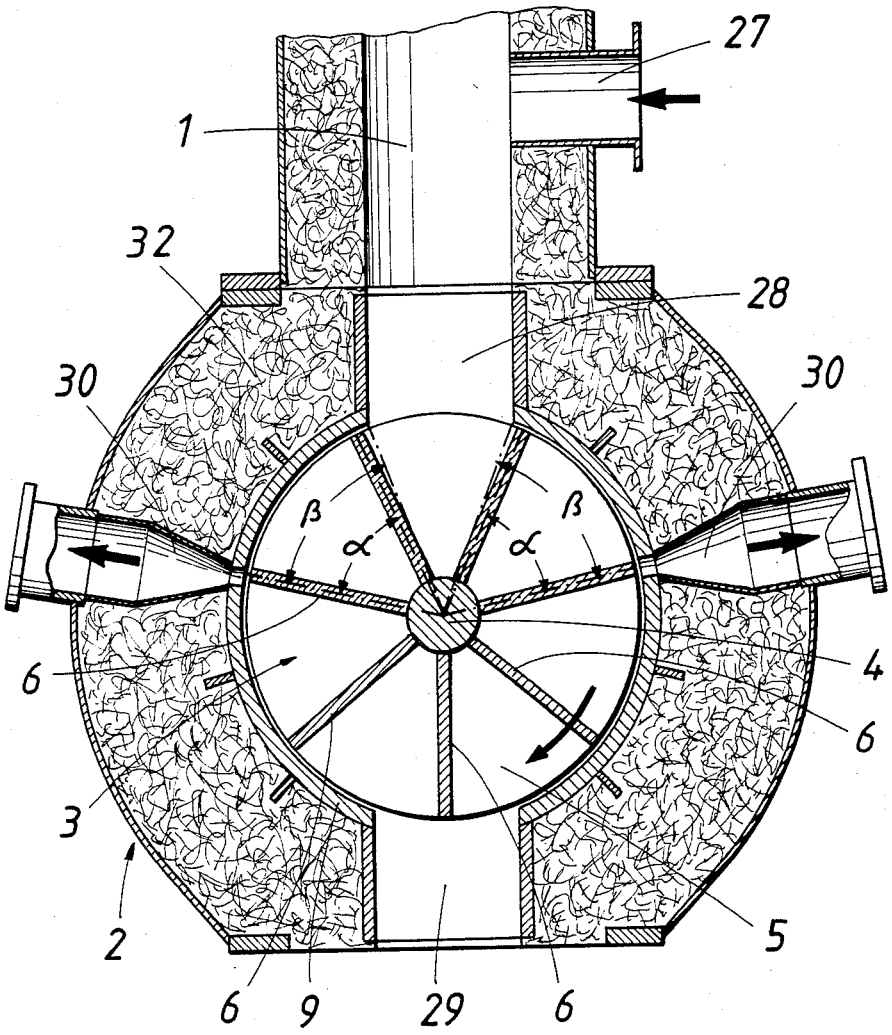
FIG. 1 is a transverse sectional view showing a discharge apparatus according to an embodiment of the invention with a cellular wheel in a lock chamber structure.
Figure 2:
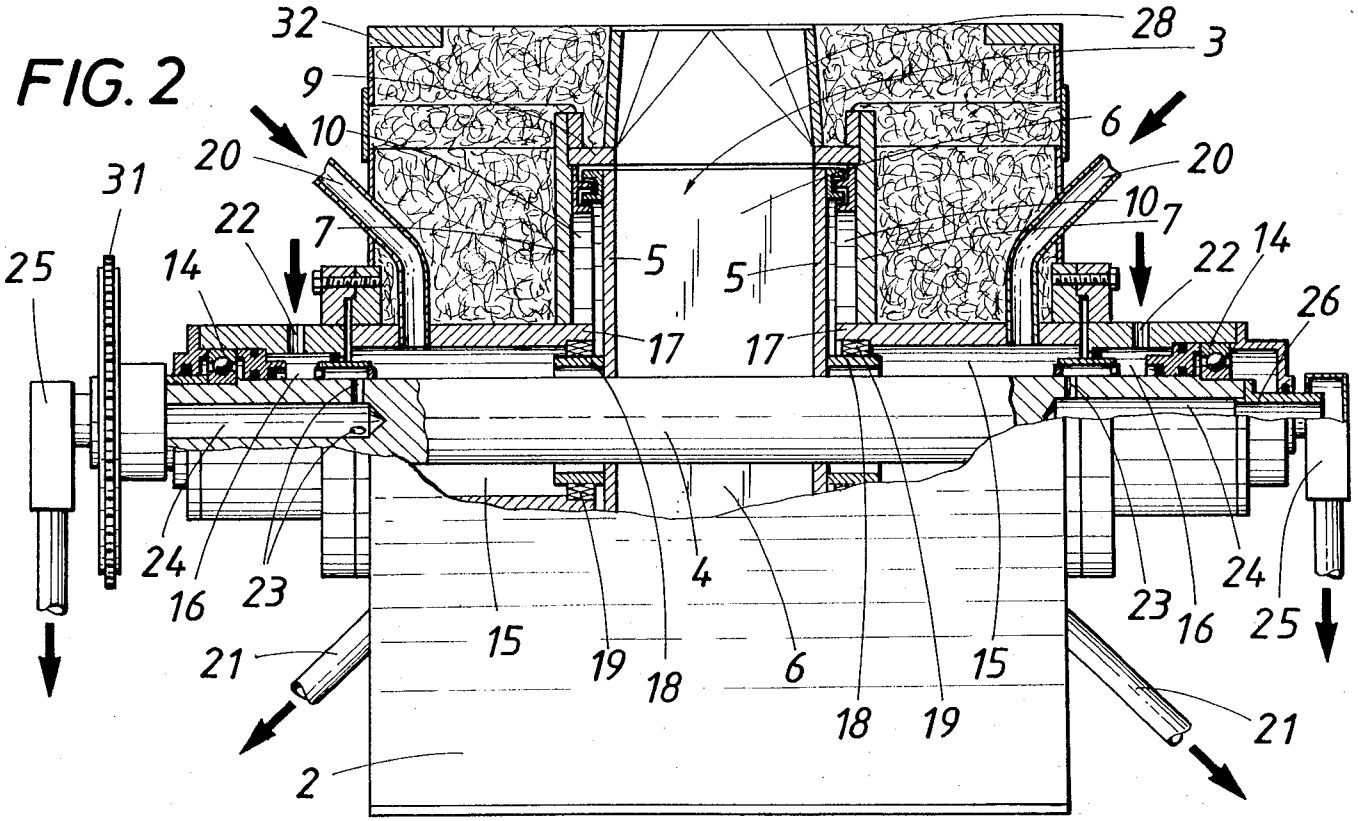
FIG. 2 is an enlarged axial sectional view showing that lock chamber structure and FIG. 3 is a fragmentary axial sectional view showing on a still larger scale the joint between the end of the cellular wheel and the end of the lock chamber structure.
Figure 3:
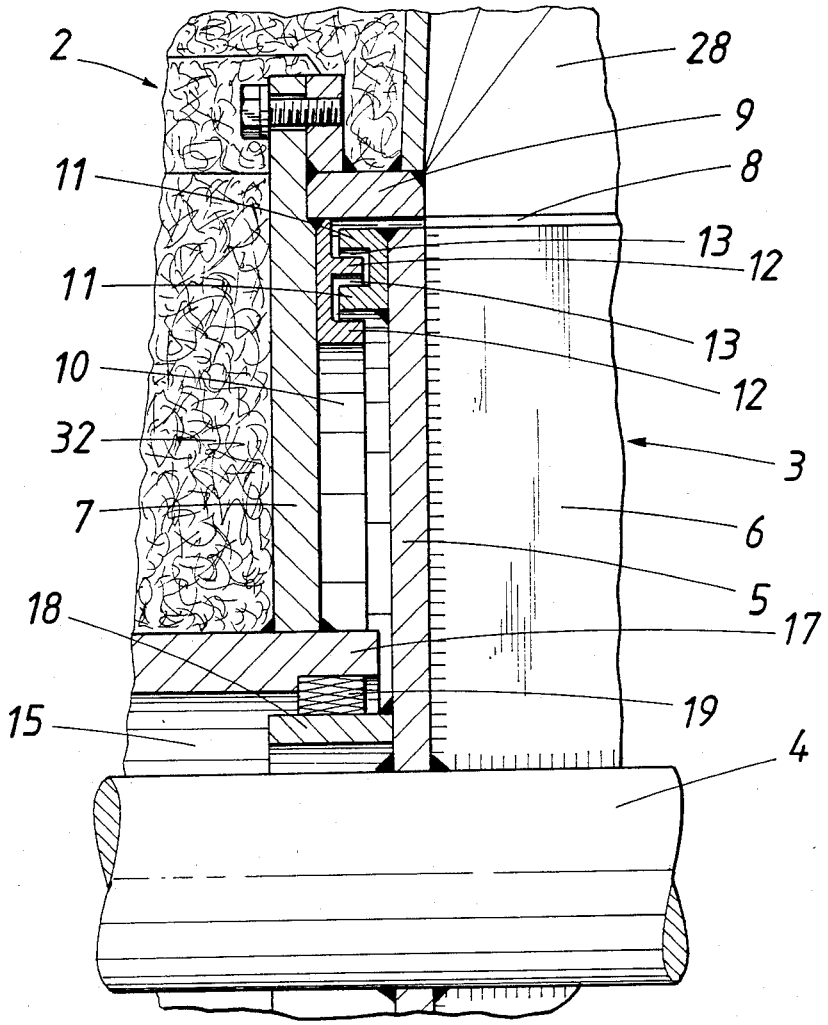

It is desired to effect a continuous discharge, e.g., of sponge iron from a low shaft furnace without an escape of gas from the furnace together with the discharge of hot solids. For this purpose the conveying device for discharging the hot solids from the furnace is connected by a conveyor duct 1 to the interior of a lock chamber structure 2. A cellular wheel 3, which is adapted to be driven, is rotatably mounted in the interior of the lock chamber structure 2. That cellular wheel 3 comprises two end discs 5, which are secured to a shaft 4, and cell-defining walls 6 disposed between the end discs 5. Each end disc 5 is axially spaced from the adjacent end wall 7 of the lock chamber structure 2. The radial clearance 8 (see particularly in FIG. 3) between the cellular wheel 3 and the peripheral wall 9 of the lock chamber structure 2 is as small as is required for the radial expansion of the cellular wheel 3 relative to the lock chamber structure 2 so that the cylinder wheel 3 is sealed as tightly as possible to the lock chamber structure 2. Adjacent to the outside periphery of the cellular wheel, the annular space 10 defined by each end wall 7 of the lock chamber structure 2 and the adjacent end disc 5 of the cellular wheel 3 is sealed by a clearance seal, which is constituted by two radially spaced apart annular flanges 11 on the end wall 5 of the cellular wheel 3 and two mating flanges 12 on the end wall 7 of the lock chamber structure 2. Because each annular flange 11 axially protrudes toward the adjacent end wall 7 and surrounds the associated mating flange 12, the thermal expansion of the cellular wheel 3 relative to the lock chamber structure 2 cannot cause the flanges 11 and 12 to contact each other and obstruct the rotation of the cellular wheel. The axial expansion results only in an axial movement of the annular flanges 11 toward the end walls 7 and the clearance is sufficient to permit that relative movement. A radial expansion of the cellular wheel 3 will result in an increase of the width of the sealing gaps 13 between the annular flanges 11 and the associated mating flanges 12 because it will increase the distance of the annular flanges 11 from the shaft 4. At the same time, the width of the radial gap 8 will be decreased to the extent by which the sealing gaps 13 are decreased so that the sealing action will be preserved in spite of the expected differential expansion of the cellular wheel 3 and the lock chamber structure 2.

To prevent an excessive heating of the bearings 14 for the shaft 4 of the cellular wheel 3, two annular cooling passages 15 and 16 for receiving a coolant are disposed between the cellular wheel 3 and each of the bearings 14 and are defined by the lock chamber structure 2 and the shaft 4. To ensure a tight seal between each annular passage 15 and the lock chamber structure 2, the latter is provided at each end with an annular flange 17, which axially protrudes toward the adjacent end disc 5 and surrounds and is radially spaced from a mating flange 18 provided on the associated end disc 5 of the cellular wheel 3. A sliding ring 19 is sealingly inserted between the annular flange 17 and the mating flange 18 and may consist, e.g., of a graphite-asbestos composition. If a temperature difference between the cellular wheel 3 and the lock chamber structure 2 results in an expansion of the mating flange 18 of the cellular wheel 3 relative to the annular flange 17 of the lock chamber structure 2, the sliding ring 19 between the flanges 17 and 18 will be more strongly compressed so that the annular passage 15 will be more tightly sealed from the lock chamber structure 2 and the annular space 10 whereas this will not adversely affect the freedom of rotation of the cellular wheel 3 because the sliding ring 19 can resiliently yield.

The coolant fed through lines 20 into the annular passage 15 consists of a cold inert gas and the heat which is absorbed by said gas is dissipated by the latter as it flows off through the lines 21. The annular passage 16 is separated from the annular passage 15 and supplied with cooling water through the supply lines 22. That cooling water is removed from the annular passage 16 through an axial bore 24, which is formed in the shaft 4 and communicates through radial bores 23 with the annular passage 24. To allow for the axial expansion of the shaft 4, the axial bore 24 is extended by an extension tube 26, which is a sliding fit in a fitting 25. It is apparent that a two-stage cooling system is available for dissipating heat and ensures that the bearings 14 for the shaft 4 of the cellular wheel 3 will not be heated to excessively high temperatures in operation.

To ensure that the compressed furnace gas cannot escape from the furnace through the conveyor duct 1, the latter is connected by a pipe 27 to a source of compressed blocking gas so that a blocking gas pressure which exceeds the gas pressure in the furnace can be built up in the conveyor duct 1. In the lock chamber structure 2, the blocking gas pressure must be reduced so that an escape of the blocking gas from the lock chamber structure 2 can be substantially prevented. This is effected by means of the cellular wheel 3. Adjacent to the conveying portion of the cellular wheel 3 and adjacent to the opposite returning portion thereof, respective exhaust gas ducts 30 communicate with the interior of the lock chamber structure 2 between its inlet 28 and outlet 29 and serve to recycle any blocking gas which has entered the lock chamber structure 2. Because the blocking gas must be heated in order to avoid a cooling of the solids from the furnace by the blocking gas so that it will not cool the solids from the furnace, a recycling of the blocking gas is of considerable economical significance.

As a sufficiently high pressure of the blocking gas should be built up in the conveyor duct 1 with economical means, the conveyor duct 1 should not communicate directly with the exhaust gas ducts 30. For this reason the flow path between the inlet 28 of the lock chamber structure and each exhaust gas duct 30 must always be interrupted by at least one cell-defining wall 6. This is accomplished in that the angular spacing $\alpha$ between two adjacent cell-defining walls 6 of the cellular wheel 3 is smaller than the angular spacing $\beta$ between each exhaust gas duct 30 and the inlet 28 of the lock chamber. The same requirement must be fulfilled with respect to the angular spacing of each exhaust gas duct 30 from the outlet 29 of the lock chamber structure if an escape of blocking gas through the outlet 29 of the lock chamber structure is to be prevented. An undesired escape of blocking gas will be even more reliably prevented if there are two or more cell-defining walls between each exhaust gas duct 30 and the outlet 29 of the lock chamber structure.

The cellular wheel 3 may be driven by means of a chain drive, which comprises a sprocket wheel 31 secured to the shaft 4. Hot solids from the furnace are conveyed by the cellular wheel 3 through the lock chamber structure 2. A controlled blocking gas pressure in the conveyor duct 1 can be maintained because the free flow path between the inlet 28 and the outlet 29 of the lock chamber structure is obstructed by the cellular wheel 3. As a result, the lock chamber 12 which accommodates the cellular wheel 3 can be used for the discharge of hot solids from the furnace but will constitute a pressure lock so that the solids from the furnace can be continuously discharged whereas an escape of the furnace gas will be prevented. In order to minimize the heat losses of the solids discharged from the furnace, the lock chamber structure 2 is provided with suitable heat insulation 32. But that heat insulation will not prevent a temperature difference between the cellular wheel 3 and the lock chamber structure 2, particularly as the discharge apparatus is started up from the cold. Owing to that temperature difference, the cellular wheel 3 will exhibit a larger thermal expansion, which can be taken up by the provision of the above-described expansion joints, which will not adversely affect the pressure seal.

What is claimed is:

1. In apparatus for discharging solids from a shaft furnace which contains a compressed furnace gas, comprising a lock chamber structure having a peripheral wall formed with an inlet and an outlet peripherally spaced from said inlet, a rotor mounted in the interior of said lock chamber structure for rotation about a predetermined axis centered with respect to said peripheral wall, said rotor being arranged to seal said inlet from said outlet, drive means for rotation said rotor about said axis, and a conveyor duct connected to said inlet and adapted to be connected to said shaft furnace and to transfer solids from said shaft furnace to said inlet, the improvement residing in that said rotor consists of a cellular wheel having a plurality of cell-defining radial walls regularly angularly spaced apart and defining successive conveying portions for conveying said solids from said inlet to said outlet during a rotation of said cellular wheel, a source of a compressed blocking gas communicates with said conveyor duct, an exhaust gas duct communicates with the interior of said lock chamber structure through said peripheral wall adjacent to said conveying portions between said inlet and said outlet, the exhaust gas duct being spaced from said inlet and from said outlet by an angle which exceeds the angular spacing of two adjacent ones of said radial walls, said drive means comprises a shaft non-rotatably connected to said rotor and two bearings disposed at opposite ends of said lock chamber structure and rotatably supporting said shaft, said lock chamber structure and said shaft define between them at least one annular passage between each of said bearings and said cellular wheel, and means is provided for passing a cooling fluid through said annular passage.

2. The improvement set forth in claim 1, wherein each of said exhaust gas ducts is spaced from said inlet and from said outlet by an angle which exceeds twice the angular spacing of two adjacent ones of said radial walls.

3. The improvement set forth in claim 1, wherein said cellular wheel comprises two axially spaced apart end discs on opposite sides of said radial walls.

4. The improvement set forth in claim 1, further comprising two of said exhaust gas ducts substantially diametrically opposite each other between said inlet and said outlet.

5. In apparatus for discharging solids from a shaft furnace which contains a compressed furnace gas, comprising a lock chamber structure having a peripheral wall formed with an inlet and an outlet peripherally spaced from said inlet, a rotor mounted in the interior of said lock chamber structure for rotation about a predetermined axis centered with respect to said peripheral wall, said rotor being arranged to seal said inlet from said outlet, drive means for rotating said rotor about said axis, and a conveyor duct connected to said inlet and adapted to be connected to said shaft furnace and to transfer solids from said shaft furnace to said inlet, the improvement residing in that said rotor consists of a cellular wheel having a plurality of cell-defining radial walls regularly angularly spaced apart and defining successive conveying portions for conveying said solids from said inlet to said outlet during a rotation of said cellular wheel, the cellular wheel comprising two axially spaced apart end discs on opposite sides of said radial walls, said lock chamber structure comprises two axially spaced apart end walls at opposite ends of said peripheral wall, each of said end discs is disposed to and axially spaced apart from one of said end walls, each of said end discs carries at least one annular flange which axially protrudes toward the adjacent one of said end walls, and each of said end walls carries a mating annular flange which axially protrudes toward the adjacent one of said end discs and is surrounded by said annular flange of said end disc to define a sealing gap therewith, a source of a compressed blocking gas communicates with said conveyor duct, and an exhaust gas duct communicates with the interior of said lock chamber structure through said peripheral wall adjacent to said conveying portions between said inlet and said outlet.

6. In apparatus for discharging solids from a shaft furnace which contains a compressed furnace gas, comprising a lock chamber structure having a peripheral wall formed with an inlet and an outlet peripherally spaced from said inlet, a rotor mounted in the interior of said lock chamber structure for rotation about a predetermined axis centered with respect to said peripheral wall, said rotor being arranged to seal said inlet from said outlet, drive means for rotating said rotor about said axis and comprising a shaft non-rotatably connected to said rotor and two bearings disposed at opposite ends of said lock chamber structure and rotatably supporting said shaft, and a conveyor duct connected to said inlet and adapted to be connected to said shaft furnace and to transfer solids from said shaft furnace to said inlet, the improvement residing in that said lock chamber structure and said shaft define between them at least one annular passage between each of said bearings and said cellular wheel, means is provided for passing a cooling fluid through said annular passage, said rotor consists of a cellular wheel having a plurality of cell-defining radial walls regularly angularly spaced apart and defining successive conveying portions for conveying said solids from said inlet to said outlet during a rotation of said cellular wheel, the cellular wheel comprising two axially spaced apart end discs on opposite sides of said radial walls, each of said annular passages adjoins the adjacent one of said end discs, said lock chamber structure has at each end an annular flange which axially protrudes toward the adjacent one of said end discs, each of said end discs carries a mating flange which is surrounded by the adjacent one of said annular flanges, a sliding sealing ring is disposed between each of said annular flanges and the associated mating flange, a source of a compressed blocking gas communicates with said conveyor duct, and an exhaust gas duct communicates with the interior of said lock chamber structure through said peripheral wall adjacent to said conveying portions between said inlet and said outlet.

* * * * *